United States Patent [19]

Yamaguchi

[11] Patent Number: 4,720,260

[45] Date of Patent: Jan. 19, 1988

[54] BURNING WICK FOR OIL BURNING APPARATUS

[75] Inventor: Isaburo Yamaguchi, Niigata, Japan

[73] Assignee: Kitate Sangyo Co., Ltd., Niigata, Japan

[21] Appl. No.: 908,505

[22] Filed: Sep. 17, 1986

[30] Foreign Application Priority Data

Sep. 17, 1985 [JP] Japan ..... 60-203537

[51] Int. Cl.[4] ..... F23D 3/18

[52] U.S. Cl. ..... 431/325

[58] Field of Search ..... 431/325, 302–309; 128/171

[56] References Cited

U.S. PATENT DOCUMENTS

| | | | |
|---|---|---|---|
| 179,346 | 6/1876 | Rauschousan | 431/325 |
| 202,358 | 4/1878 | Mayo | 431/325 |
| 1,274,626 | 8/1918 | Steup | 431/325 |
| 1,921,999 | 8/1933 | Dickinson | 128/171 |
| 2,226,793 | 12/1940 | Walters | 431/325 |
| 4,652,235 | 3/1987 | Yamaguchi | 431/325 |

FOREIGN PATENT DOCUMENTS

| | | | |
|---|---|---|---|
| 0101205 | 6/1982 | Japan | 431/325 |

*Primary Examiner*—Margaret A. Focarino

*Attorney, Agent, or Firm*—Young & Thompson

[57] ABSTRACT

A tubular burning wick for oil burning apparatus such as an oil stove can be manufactured in a simple manner without requiring any stitching operation during its production to preserve its tubular form. The burning wick is produced by knitting a band of wick cloth having at least a burner part made of non-combustible textile material and an oil suction part made of oil-soakable fiber material both being connected and extending parallel in the longitudinal direction, cutting laterally the band of wick cloth at regular intervals into pieces of a predetermined length, looping each piece of wick cloth into a tube by abutting the opposite cut ends of the piece and bonding the axial abutment seam with at least one special binder element. The binder element comprises a binder body having a lesser extent than the abutment seam of the tubular burning wick and a plurality of perpendicular claws projecting from the binder body. Each claw has a sharp top and the binder element is attached to the burning wick along and astride the axial abutment seam with the plurality of claws piercing through the tubular wick and the claw tops pierced therethrough being folded so as to embrace the wick cloth firmly and form an integrated tubular burning wick.

13 Claims, 12 Drawing Figures

BURNING WICK FOR OIL BURNING APPARATUS

BACKGROUND OF THE INVENTION

The present invention relates to a tubular burning wick for oil burning apparatus such as an oil stove, which can be manufactured in a simple manner without requiring any stitching work during the production thereof to preserve its tubular form. More particularly, the invention concerns a stitchless tubular burning wick produced from a length of wick cloth having at least a burner part made of non-combustible textile material and an oil suction part made of oil-soakable fiber material. The cloth is looped into a tube by abutting together the opposite ends of the length of wick cloth and bonding the abutment seam firmly along its axial extent using a special binder element.

Various burning wicks for oil burning apparatus such as an oil stove are known, which have a tubular form and are mounted on a cylindrical wick holder and which are raised or lowered for burning or extinguishing respectively, by manipulating a pinion shaft so as to extend or retract the burner part of the burning wick.

Burning wicks having a burner part and an oil suction part or having a burner part, an oil suction part and a stretchable part are known, for example, from Japanese Laid Open Patent Applications Nos. 17038/1976, 44325/1976 and Japanese Laid Open Utility Model Application No. 157535/1977.

In these burning wicks, a stitching operation, namely, a machine stitching operation, is inevitable during the production process.

Thus, in one example of the production of burning wick, a starting wick cloth having a burner part and an oil suction part is knitted into a continuous band on a knitting machine. This band of wick cloth is then cut to predetermined lengths by a cutter, each of which lengths is looped to form a tube by overlapping the opposite cut ends, whereupon the overlapped end portions art stitched together along the junction seam in a zigzag stitching.

In another example of production of burning wick, a tubular cloth for the burner part and a tubular cloth for the oil suction part of the burning wick are knitted separately on a knitting machine and both the tubes thus knitted are then placed in coaxial alignment such that the adjacent peripheral edges of the tubes are joined together, whereupon these edges are stitched together along the joining seam to form an integrated tubular burning wick.

As indicated above, there has been no substitute for the stitching operation in either of the examples mentioned above, either in the axial or circumferential direction along the junction seam, in order to obtain a tubular burning wick. Especially for tubular burning wicks having smaller diameters, the stitching operation requires special efforts due to the necessity of careful handling, in addition to the easily yieldable nature of the cloth, which results in a decrease in productivity. It is also disadvantageous that the junction portion of the wick has low resistance to tension and torsion due to the occurrence of a weak zone therein resulting from the simple zigzag stitching, which occasionally leads to a failure in the movement of the wick in the form of a deformation of the junction portion due to the external forces imparted in various directions after repeated up-and-down operations of the wick. A further disadvantage is that much human time and skill is necessary for stitching such abutment seams.

SUMMARY OF THE INVENTION

The first object of the invention is to provide a stitchless tubular burning wick for oil burning apparatus, which has higher mechanical strength to preserve its stable tubular form and does not require the burdensome stitching operation in the production process thereby to allow its manufacture in an economical and efficient manner.

The second object of the present invention is to provide a tubular stitchless burning wick for oil burning apparatus having high strength and produced from a length of wick cloth by looping said length of wick cloth into a tube by abutting together the opposite ends of said length of wick cloth and bonding the thus-formed axial abutment seam firmly using a special binder element that can be mass produced at low cost.

The above objects can be attained in accordance with the present invention by providing a stitchless tubular burning wick for oil burning apparatus produced by knitting a band of wick cloth having at least a burner part made of non-combustible textile material and an oil suction part made of oil-soakable fiber material extending parallel to one another in the longitudinal direction of said band, cutting transversely said band of wick cloth at constant intervals into pieces each having a predetermined length, looping each piece of wick cloth having a predetermined length into a tube by abutting the opposite cut ends of the piece and bonding the axial abutment seam with at least one special binder element, wherein said binder element comprises a binder body having a lesser extent than the extent of said abutment seam and a plurality of claws formed projecting from the binder body essentially perpendicular thereto and each having a sharp top and wherein said binder element is attached to the burning wick along and astride the axial abutment seam thereof with said plurality of claws piercing through said tubular wick and the claw tops pierced therethrough being folded so as to embrace the wick cloth firmly and form an integrated tubular burning wick.

The burning wick according to the present invention requires only simple operations for the production thereof. A piece of wick cloth cut to a predetermined length is looped by abutting the opposite cut ends of said piece of wick cloth to form a tube and the binder element is attached to the burning wick along and astride the thus-formed abutment seam by sticking the plurality of claws disposed on the binder element into the wick cloth and thereafter folding the claw tops pierced therethrough so as fixedly to hold the wick cloth. In this manner, the burdensome and problematic stitching operation on a stitching machine can be dispensed with in the manufacture of an integrated tubular burning wick.

The binder element consists of a relatively thin material, so that it conforms better to the wick cloth, whereby a tight connection of the binder element to the wick cloth can be effectively achieved. Due to the non-elastic nature and the high mechanical strength of the binder element, any elongation or contraction of the burning wick is prevented by the binder element and the mechanical resistance to displacement and torsion etc. of the abutment portion is also increased.

The binder element can be attached to the wick cloth directly or alternatively, in a known manner, it can be attached to the wick cloth through the intermediary of a supporting tap affixed to the tubular burning wick for maintaining the wick in a stiff tubular shape. For burning wicks prepared by knitting on known knitting machines, a region along the circumferential seam joining the burner part and the oil suction part can be consolidated by the binder element according to the present invention.

The binder element according to the present invention can be provided with perforations or openings, such as circles, ellipses, polygons and the like, which will serve both to lighten the binder element and to ensure the secure fixation of the element to the burning wick by possible entanglement of the fibers of the wick in such openings.

The binder element according to the present invention is preferably made of a relatively resilient material, such as thin metal sheet, foil or the like. Such a thin metal sheet may be of stainless steel, aluminum, aluminum foil, copper or the like. The sheet made of such a material can be provided with punched-out holes or openings having various configurations, such as circles, ellipses, triangles, quadrilaterals, etc. The binder element can be produced by cutting a wire net to an appropriate size. Then, each cut end of the net wire is bent so as to form the perpendicular claws.

BRIEF DESCRIPTION OF THE DRAWINGS

The present invention will be further described with reference to the accompanying drawings, which illustrate various embodiments of the wick and binder element by way of non-limiting example, and in which.

DETAILED DESCRIPTION OF THE INVENTION

Figure 1:
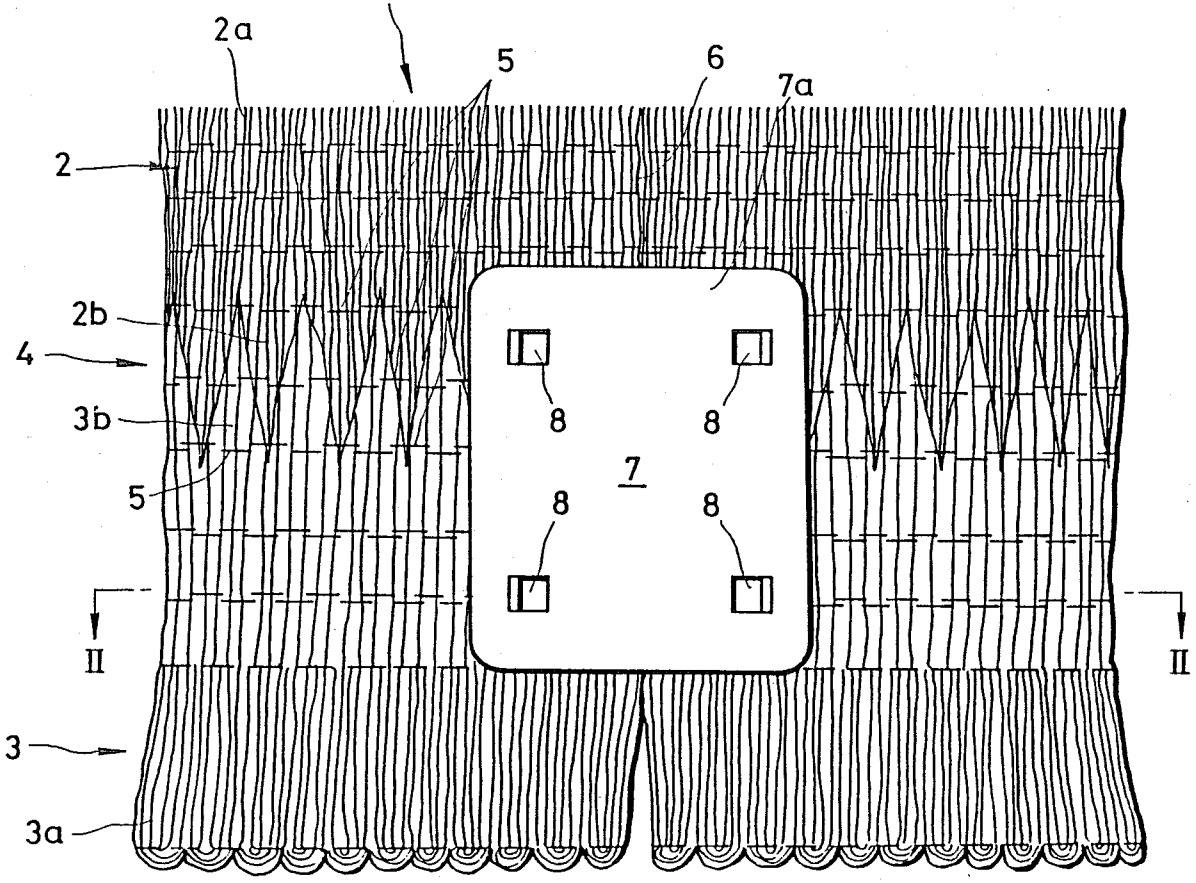
FIG. 1 is a front view of a first embodiment of the stitchless tubular burning wick according to the present invention, in which the abutment seam of the wick cloth is bonded by a binder element.

The burning wick 1 shown in FIG. 1 has a burner part 2 and an oil suction part 3. The burner part 2 consists of knitted bundles or slivers 2*a* of non-combustible fiber, such as glass fiber. The oil suction part 3 consists of knitted bundles or slivers 3*a* of oil-soakable fiber, such as cotton, staple fiber and the like.

The burner part 2 and oil suction part 3 are knitted together simultaneously on an automatic knitting machine, such as a Raschel loom. Thus, a cloth for a burning wick composed of distinct but bodily connected sections of different materials extending parallel to one another in the longitudinal direction of the cloth is knitted continuously in an extensive band. At the junction portion 4 between the burner part 2 and the oil suction part 3, the respective ends 2*b* and 3*b* of both the fiber yarns 2*a* and 3*a* are interleaved. The interleaved portion is stitched by a plurality of binding yarns 5 to reinforce the integral binding.

The band thus obtained is then cut laterally at predetermined longitudinal intervals into pieces of wick cloth having a prdetermined length. The starting wick cloth thus obtained is then looped into a tube by abutting the opposite cut ends of a said piece. The abutment seam of the thus-formed tubular wick cloth is then bonded by means of a binder element 7 attached thereto along and astride the seam.

Figure 2:
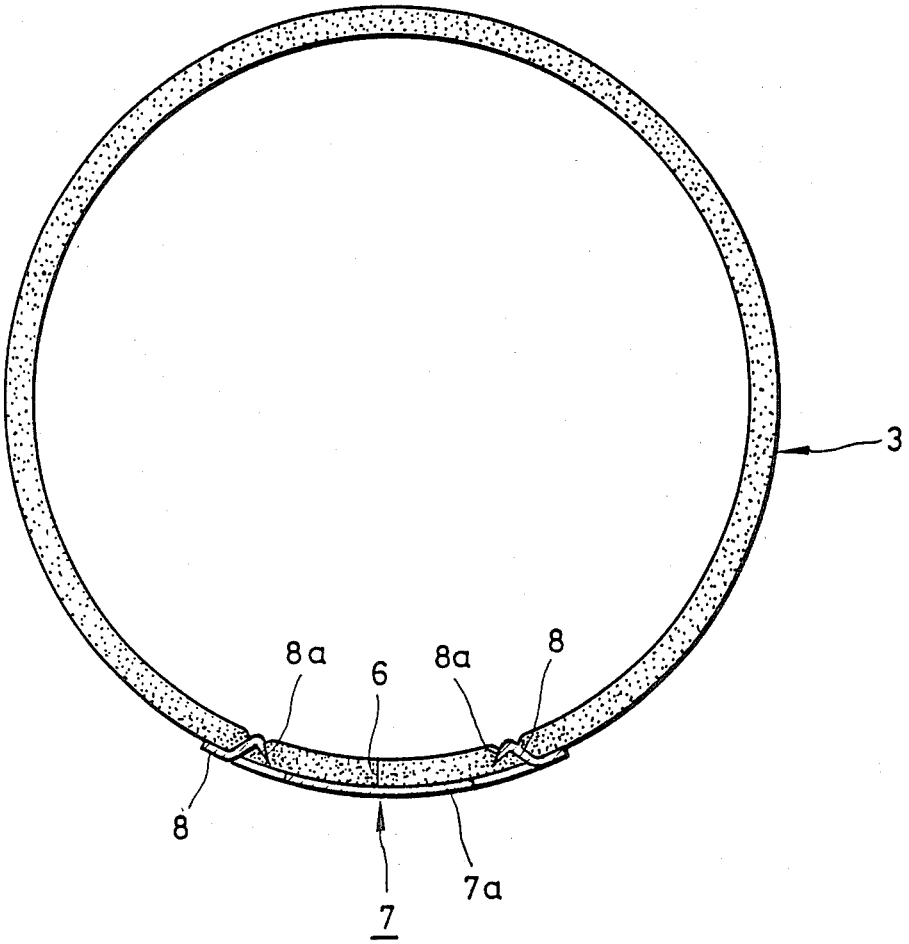
FIG. 2 is a sectional view of the embodiment of FIG. 1 along the line II—II of FIG. 1.

The binder element 7 in the embodiment of FIG. 1 has a substantially rectangular binder body 7*a*. The binder body 7*a* is provided near its four corners with claws 8. Each claw 8 can be formed by making a U-shaped incision in the sheet of binder element so as to leave a lug sustained on the sheet by the uncut fourth side of the U-shaped incision. This lug is bent perpendicular to the sheet of form a claw. The top of the claw 8 is cut to a sharp point, such as the vertex of a triangle or the like. The binder element is attached to the abutment seam 6 of the tubular burning wick such that it is astride the seam and extends equally on both sides of the seam. The claws 8 are then pressed into the wick cloth to pierce it through and each top of the claws is then bent so as to embrace the slivers 3*a* of the suction part 3. In the same way, the textile material 2*a* is also grasped tightly by the other claws 8. In this manner, the binder element 7 is fitted firmly onto the burning wick and is combined therewith integrally by the claws stuck therethrough, as best seen in FIG. 2.

Figure 3:
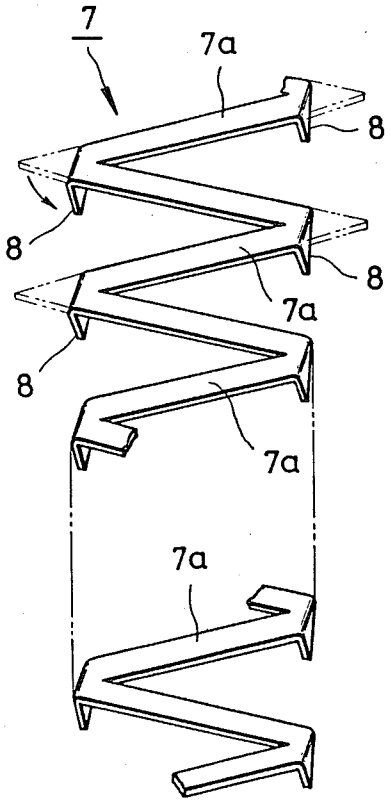
FIG. 3 is a perspective view of another embodiment in which the binder element has a zigzag form.

The embodiment of the binder element 7 shown in FIG. 3 is produced by cutting a row of V-shaped sawtooth-like indentations in each side of a band of sheet metal and in an offset manner to form a zigzag binder element 7. Each of the sharp corners left after the cutting is then bent nearly perpendicular to the sheet face, so as to form claws 8. This binder element can be applied in the same manner as explained above by sticking the claws 8 into the wick cloth to pierce it through and then bending or folding the claw tops to embrace the wick cloth firmly. The binder element can also be formed in an undulating shape.

It will be noted that the binder element according to the present invention can also be used for binding various materials including corrugated cardboard boxes and the like, without being limited to just the application of binding a tubular burning wick.

Figure 4:
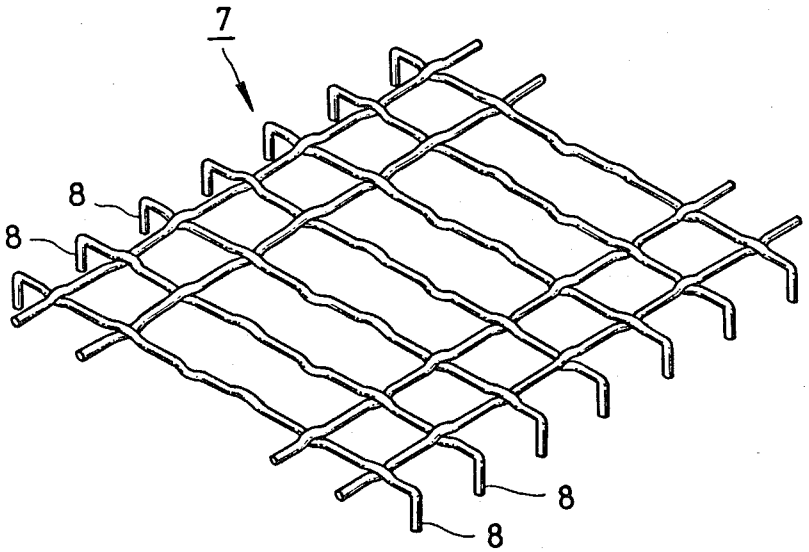
FIG. 4 illustrates in perspective view another embodiment of the binder element consisting of wire net.

The binder element 7 shown in FIG. 4 is formed from a wire net. A wire net is cut to a section of an appropriate size. The cut ends of the wire left after the cutting of the wire net are then bent so as to form the grasping claws 8, in a similar manner as above.

Figure 5:
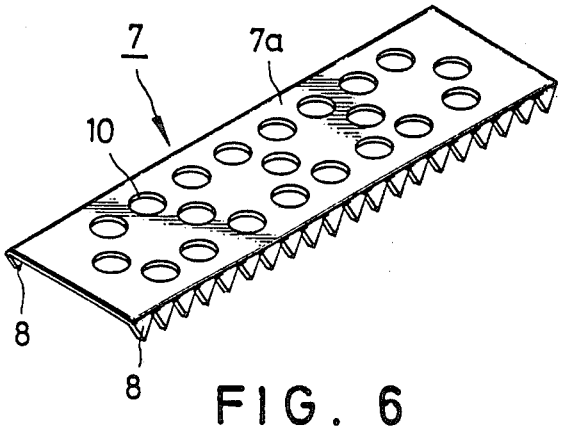
FIGS. 5 to 8 illustrate in perspective different embodiments of the binder elements, each being prepared from a sheet having different perforations.

The binder element 7 shown in FIG. 5 has a rectangular shape. A plurality of circular holes 10 are punched out from the binder body 7*a* in a predetermined pattern, which serves to lighten the binder element 7 and give it a decorative appearance. Both longitudinal edges of the binder body 7*a* are bent perpendicular to the body 7*a* and each is cut in a sawtooth pattern to form the claws 8.

Figure 6:
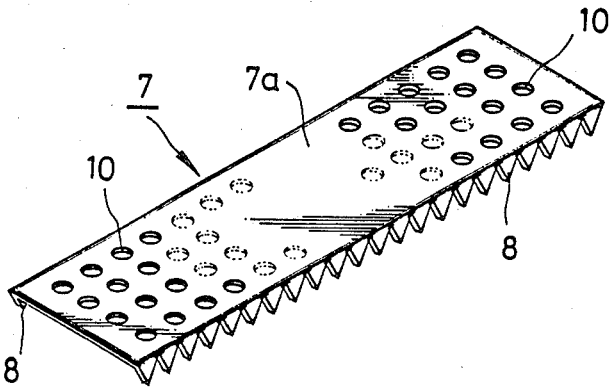

The binder element 7 shown in FIG. 6 has a structure essentially the same as that shown in FIG. 5. Here, however, the openings 10 disposed on the binder body 7*a* are in alignment in both the longitudinal and transverse directions of the body 7*a*. They impart a different ornamental appearance.

Figure 7:
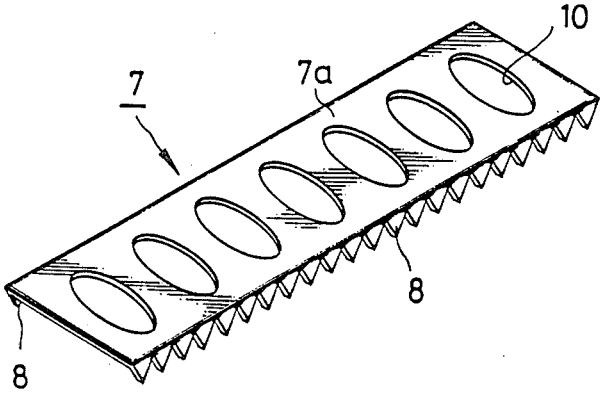
Figure 8:
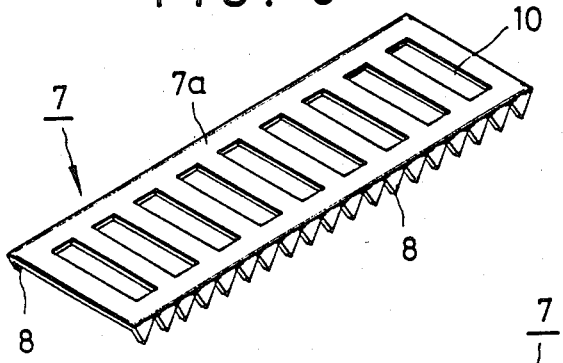

The binder element 7 shown in FIG. 7 is different from that of FIG. 5 in that each perforation 10 has an elliptical configuration. The embodiment of FIG. 8 is different from that of FIG. 5 in that each of the perforations has a rectangular configuration.

Figure 9:
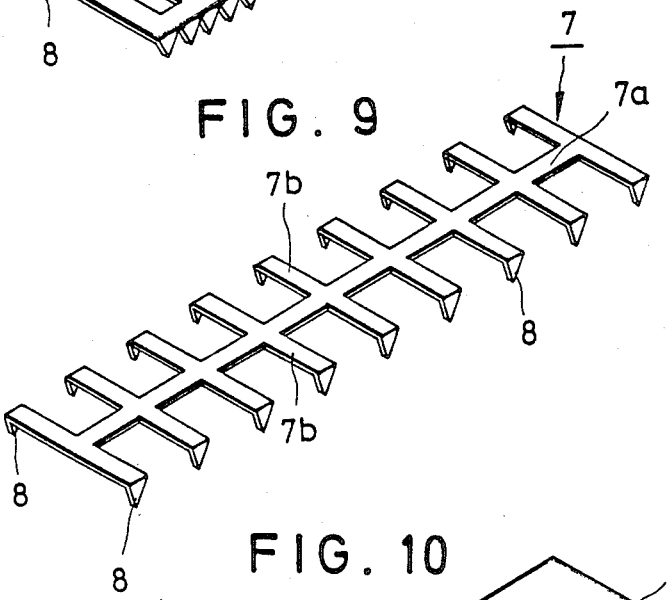
FIG. 9 shows in perspective view yet another embodiment of the binder element, having a shape similar to a centipede.

The binder element 7 shown in FIG. 9 comprises lateral arms *7b, 7b* projecting at regular intervals from a central stem *7a* of the binder element. Each end of the projecting arms *7b* is bent perpendicular to the plane of the stem or binder body *7a* to form a sharp claw 8.

Figure 10:
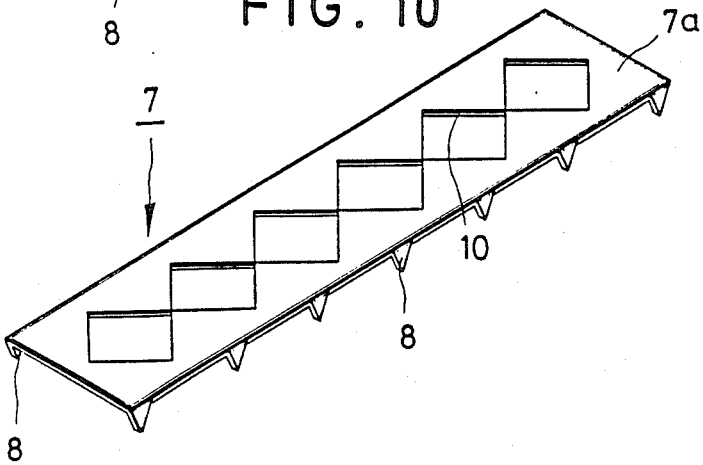
FIGS. 10 to 12 illustrate in perspective further embodiments of the binder element, having claws and openings of different configurations.

The binder element 7 shown in FIG. 10 has on its binder body *7a* a succession of holes 10 each having a rhombic configuration. The binder element of this embodiment has claws 8 formed from both longitudinal edges, but at larger intervals.

Figure 11:
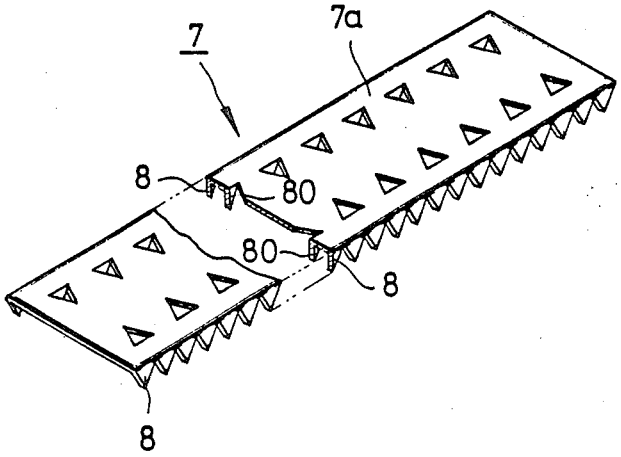

The binder element 7 shown in FIG. 11 has two pairs of parallel rows of claws 8, each pair of which is disposed on a respective side of the binder body *7a*. The pair of rows of claws is formed by bending the side edge of the binder body *7a* and cutting the edge to the shape of sawteeth, on the one hand, and making in the binder body *7a* a row of V-shaped incisions, said row extending parallel to the side edge at a distance therefrom, the resultant V-shaped lugs then being bent nearly perpendicular to the binder body *7a* to form triangular claws 80, on the other hand. Thus, the row of claws 8 and the row of claws 80 form a pair of claw lines to embrace the wick cloth. This embodiment of the binder element has an increased binding effect for the wick cloth, since each pair of the rows of claws grasps the wick cloth firmly from both sides of the wick.

Figure 12:
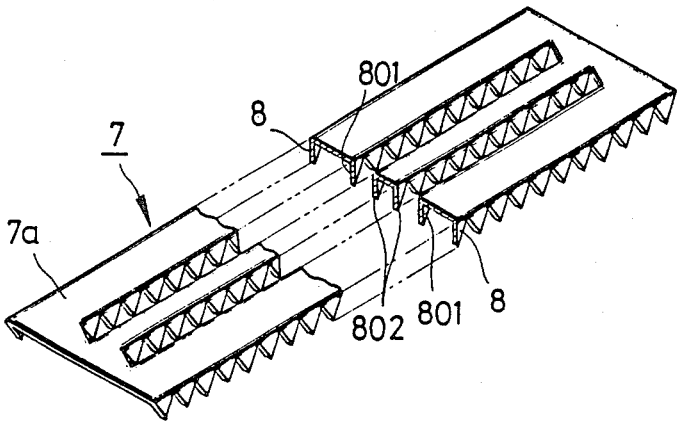

The binder element 7 shown in FIG. 12 has three pairs of rows of claws formed on the binder body *7a*. Here, the inner rows of claws 801, 802 are formed by cutting in the binder body *7a* two incision lines extending parallel to the sides of the binder element 7 at an appropriate distance both from each other and from the corresponding side, each of the incision lines having a zigzag shape. The sawteeth thus formed are then bent perpendicular to the binder body *7a* to form the rows of claws 801, 802. In this embodiment, three pairs of rows of claws extending parallel are formed in the longitudinal direction. The grasping force of this embodiment is greater than that of the embodiment of FIG. 11.

What is claimed is:

1. A tubular burning wick for oil burning apparatus, comprising: a band of wick cloth having opposite cut ends, an upper burner part and a lower oil suction part, said oppoiste ends being abutted to form said band into a tube and define an abutment seam extending axially of said tube; and a binder element superposed on said abutment seam, said binder element comprising a body superposed on the exterior surface of said tube and extending circumferentially of said tube on both sides of said abutment seam, and first and second opposite peripheral portions extending axially of said tube, each said peripheral portion having a plurality of claws extending radially inwardly of said tube, said claws passing through said tube and being bent relative to said body into contact with the interior surface of said tube; all said claws being identical, said claws of said first peripheral portion having ends extending toward said second peripheral portion and said claws of said second peripheral portion having ends extending toward said first peripheral portion.

2. A burning wick according to claim 1, wherein said binder element has a rectangular binder body and four claws disposed at each corner of said binder body, each said claw being substantially triangular and substantially perpendicular to said body and having an edge integral with said body.

3. A burning wick according to claim 1, wherein said body has a zigzag shape, said zig-zag extending axially of said tube and defining a series of apices along each said opposite peripheral portion, said claw being formed from said apices.

4. A burning wick according to claim 1, wherein said body comprises a wire screen having a suitable strength to bind said seam and a substantially rectangular configuration, said claws being formed from each wire end along said opposite peripheral portions.

5. A burning wick according to claim 1, wherein said body is rectangular and has openings of any desired geometrical shape so as to lighten said binder element and ensure tight engagement of said body with said wick cloth.

6. A burning wick according to claim 1, wherein said body has laterally extending arms projecting from a central stem each said arm having a sharpened end from which a said claw is formed.

7. A burning wick according to claim 1, wherein said body has two pairs of parallel rows of said claws, each said pair being disposed on a respective said peripheral portion of said body, each said claw being triangular.

8. A burning wick according to claim 1, wherein said binder element comprises a material selected from the group consisting of stainless steel and aluminum.

9. Method of producing a tubular burning wick for oil burning apparatus, comprising the steps of: providing a band of wick cloth having opposite cut ends, an upper burner part and a lower oil suction part; forming said band into a tube by abutting said opposite ends to form an abutment seam extending axially of said tube; superposing a binder element on said abutment seam exteriorly of said tube, said binder element having first and second peripheral portions extending axially on both sides of said seam and claws formed from said peripheral portions, said claws extending substantially radially inwardly of said tube; forcing said claws radially inwardly through said tube, whereby at least a portion of each said claw is disposed interiorly of said tube; and bending at least said interiorly disposed portion of each said claw on said first peripheral portion toward said second peripheral portion and each said claw on said second peripheral portion toward said first peripheral portion, all said claws being identical and bent against the interior surface of said tube; thereby to secure said abutment seam with said binder element.

10. Method according to claim 9, wherein said binder element comprises sawtooth-like claws extending along both said peripheral portions, said claws extending substantially perpendicular to said binder element.

11. Method according to claim 10, wherein said binder element comprises a row of V-shaped incisions adjacent each said peripheral portion, each said incision defining a triangular claw being bent radially inwardly of said tube and substantially perpendicular to said binder element.

12. Method according to claim 10, wherein said binder element comprises a zigzag incision extending parallel to and adjacent each said peripheral portion, each said zigzag incision defining a pair of rows of triangular claws, each said claw being bent radially inwardly of said tube and substantially perpendicular to said binder element.

13. Method according to claim 9, wherein said binder element is formed from a thin sheet of a materal selected from the group consisting of stainless steel and aluminum.

* * * * *